US010500886B1

(12) United States Patent
Tsai et al.

(10) Patent No.: US 10,500,886 B1
(45) Date of Patent: Dec. 10, 2019

(54) MULTI-PASS UV INKJET PRINTER FOR OUTPUTTING HIGH GLOSSY VARNISH AND PRINTING METHOD USING THE SAME

(71) Applicant: GREAT COMPUTER CORP., New Taipei (TW)

(72) Inventors: Chen-Chien Tsai, New Taipei (TW); Chih-Hua Yen, New Taipei (TW); Hui-Te Yu, New Taipei (TW)

(73) Assignee: GREAT COMPUTER CORPORATION, New Taipei (TW)

( * ) Notice: Subject to any disclaimer, the term of this patent is extended or adjusted under 35 U.S.C. 154(b) by 0 days.

(21) Appl. No.: 16/545,538

(22) Filed: Aug. 20, 2019

Related U.S. Application Data

(62) Division of application No. 15/870,901, filed on Jan. 13, 2018, now Pat. No. 10,427,442.

(51) Int. Cl.
*B41M 7/00* (2006.01)
*B41J 2/435* (2006.01)

(52) U.S. Cl.
CPC ..... *B41M 7/0081* (2013.01); *B41J 2/435* (2013.01)

(58) Field of Classification Search
CPC ..... B41M 7/0081; B41J 2/435
See application file for complete search history.

(56) References Cited

U.S. PATENT DOCUMENTS

| | | | | |
|---|---|---|---|---|
| 5,469,198 | A | 11/1995 | Kadonaga | |
| 5,923,349 | A | 7/1999 | Meyer | |
| 2008/0174649 | A1 | 7/2008 | Nakano et al. | |
| 2014/0292877 | A1* | 10/2014 | Fujisawa | B41J 11/002 347/16 |

* cited by examiner

*Primary Examiner* — Bradley W Thies
(74) *Attorney, Agent, or Firm* — Muncy, Geissler, Olds & Lowe, P.C.

(57) ABSTRACT

A multi-pass UV inkjet printer for outputting high glossy varnish and a printing method using the same includes providing a side UV light irradiation device at a side of an inkjet module and a front UV light irradiation device in front of the inkjet module not overlapped by a varnish print head. During output of the varnish, varnish outputted on a substrate in the $n^{th}$ pass is passed under the side UV light irradiation device with a lower UV irradiation power during or after the $n+1^{th}$ pass performed by the UV inkjet printer for shaping or temporarily not curing, and then during or after the next pass, the varnish is passed under the front UV light irradiation device with a higher UV irradiation power for complete curing, thereby increasing production yield.

4 Claims, 5 Drawing Sheets

MULTI-PASS UV INKJET PRINTER FOR OUTPUTTING HIGH GLOSSY VARNISH AND PRINTING METHOD USING THE SAME

BACKGROUND OF THE INVENTION

Field of the Invention

The present invention relates to a multi-pass UV inkjet printer for outputting high glossy varnish and a printing method using the same, and more particularly, to a multi-pass UV inkjet printer that completes delayed curing of varnish in one process and a printing method using the same.

Description of the Related Art

UV inkjet printers have been widely used in professional commercial output applications (e.g. advertisements, posters, high-quality art reproductions etc.) because they allow printing on various types and thicknesses of materials at relatively high printing speeds and has stable and uniform printing quality. With its reliable performance, the time and labor invested in preparing color separation plates is eliminated, which enables faster printing.

In commercially available UV inkjet printers at present, an inkjet module controlled to travel back and forth is provided on a sliding platform of the machine. A plurality of inkjet cartridges are provided on the inkjet module and a plurality of print heads corresponding to the respective inkjet cartridges are provided at the bottom of the inkjet module. Inks are ejected from nozzles located at the bottom of the print heads onto a substrate to be printed. The inks jetted on the substrate to be printed are then quickly hardened (cured) by subjecting them to UV light from a UV lamp provided at a side of the inkjet module. During printing of the substrate, a region of interest traditionally can be printed using a unidirectional printing method or a bi-directional printing method to save print time.

In order for a printed product to display a rich color scale, a color separating software can be used for color separation of the UV inkjet printer, which separates the printing of an image to be printed into multiple passes based on the file size and resolution of the image, such that the print heads print the data to be printed in multiple passes. Refer to the printing methods and devices proposed in U.S. Pat. Nos. 5,469,198 and 5,923,349 for more details on the multi-pass printing techniques.

If a transparent glossy surface finish is desired on the substrate to be printed, a layer of varnish is typically applied after inks are printed on the patterns at every region of interest on the substrate, and then the varnish is temporarily shaped (semi-cured) by a UV lamp at a low energy, or the varnish is first left untouched. Once printing of the entire substrate is finished, the whole inkjet module then returns to the starting point and completely cures the varnish jetted on the regions by the UV lamp with 100% energy. As a result, a transparent glossy layer is formed on the patterns by such a delayed curing process. The finished product will have a transparent textured surface.

SUMMARY OF THE INVENTION

However, this delayed varnish curing process requires double the time for the varnish to be completely cured. Moreover, while the semi-cured or uncured varnish is waiting to be completely cured in a final step, surface defects may occur due to dusts attaching onto the semi-cure or uncured varnish. Thus, there is still room for improvements in the printing technique.

Therefore, there is a need in the art for a UV inkjet printer and a printing method using the same that address the shortcomings of the delayed curing process described above to improve the glossiness and quality of a printed surface.

An objective of the present invention is provide a multi-pass UV inkjet printer for outputting high glossy varnish and a printing method using the same that improves the quality of varnish on the printed surface while significantly increasing production yield.

In order to achieve the above and other objectives, a multi-pass UV inkjet printer for outputting high glossy varnish is provided by the present invention, which may include an inkjet module for performing a printing job by moving back and forth across the printer, the inkjet module having a varnish print head for outputting varnish on a substrate. The multi-pass UV inkjet printer may include: a side UV light irradiation device provided at a side of the inkjet module; and a front UV light irradiation device provided in front of the inkjet module not overlapping with the varnish print head. As such, the side UV light irradiation device and the front UV light irradiation device are activated at the same as the varnish is being outputted, and the UV irradiation power of the side UV light irradiation device is less than the UV irradiation power of the front UV light irradiation device. As a result, during printing, the varnish on the substrate is first shaped or temporarily not cured by the side UV light irradiation device, and then completely cured by the front UV light irradiation device.

In addition, a printing method using the above multi-pass UV inkjet printer for outputting high glossy varnish is provided by the present invention, which may include the following steps of: providing a side UV light irradiation device at a side of the inkjet module and a front UV light irradiation device in front of the inkjet module not overlapped by the varnish print head; during output of the varnish, dividing each print region in data to be printed into a plurality of passes and activating the side UV light irradiation device and the front UV light irradiation device at the same time, wherein the irradiation power of the side UV light irradiation device is less than that of the front UV light irradiation device, such that when the substrate is being conveyed forward, varnish outputted on the substrate in the $n^{th}$ pass is passed under the side UV light irradiation device for shaping during or after the $n+1^{th}$ pass performed by the UV inkjet printer; and passing the varnish outputted on the substrate in the $n^{th}$ pass under the front UV light irradiation device for complete curing during or after the next pass of the $n+1^{th}$ pass.

During implementation, the width of an irradiation area of the front UV light irradiation device is greater than the width of one pass.

During implementation, a width of the side UV light irradiation device in a direction parallel with the varnish print head is less than or equal to a width of the varnish print head, and the side UV light irradiation device overlaps with the varnish print head in a direction perpendicular to the varnish print head.

During implementation, when the width of the side UV light irradiation device is less than the width of the varnish print head, the width of the area not overlapped by the varnish print head and the side UV light irradiation device in a direction perpendicular to the varnish print head is greater than or equal to the width of one pass.

During implementation, the side UV light irradiation device is greater than or equal to 0% of UV irradiation power activation, and the front UV light irradiation device is less than or equal to 100% of UV irradiation power activation to cure the varnish on the substrate.

During implementation, the side UV light irradiation device and the front UV light irradiation device are activated at the same time to shape and cure varnish of different passes on the substrate.

The multi-pass UV inkjet printer provided by the present invention and the printing method using the same is capable of providing a shorter delayed curing process while significantly increasing production yield.

In order to fully understand the present invention, the specific content of and the technical effects achieved by the present invention are described in details with preferred embodiments illustrated in conjunction with the accompanying drawings.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
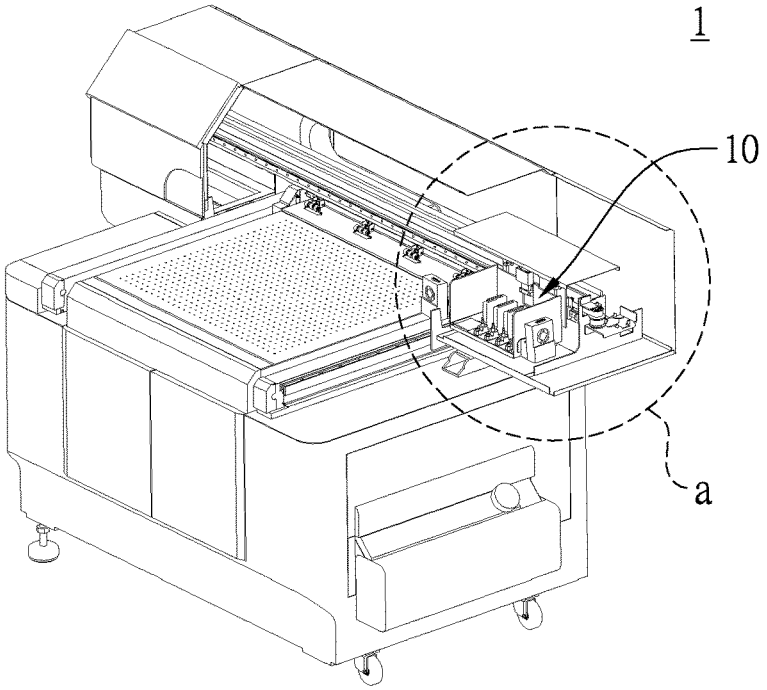
FIG. 1 is a schematic diagram depicting the appearance of a multi-pass UV inkjet printer in accordance with an embodiment of the present invention.
Figure 2:
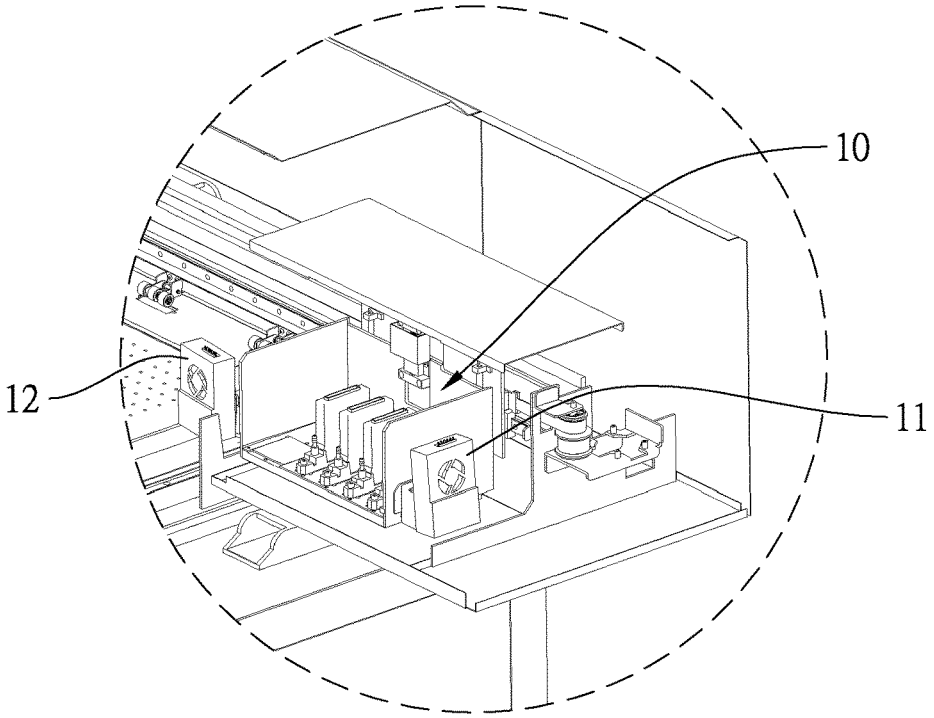
FIG. 2 is a partially enlarged view of an inkjet module in the embodiment of FIG. 1.
Figure 3:
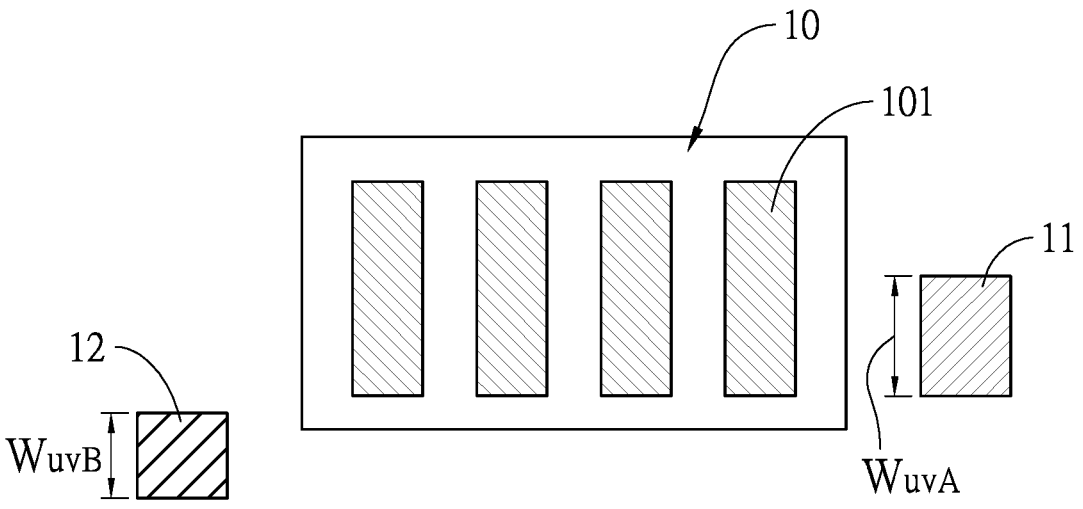
FIG. 3 is a schematic diagram depicting the configuration of the inkjet module, a side UV light irradiation device and a front UV light irradiation device in the embodiment of FIG. 1.

Referring to FIGS. 1 to 3, a multi-pass UV inkjet printer for outputting high glossy varnish 1 in accordance with a first embodiment of the present invention is shown. The UV inkjet printer 1 includes an inkjet module 10 for performing printing jobs by moving back and forth (side to side) along a traverse axis of the printer, a side UV light irradiation device 11 located at a side of the inkjet module 10 and a front UV light irradiation device 12, wherein the inkjet module 10 includes a plurality of color inkjet print heads for outputting different colors on a substrate (not shown) and a varnish print head 101 for outputting varnish on the substrate being conveyed in a direction perpendicular to the traverse axis. The side UV light irradiation device 11 and the front UV light irradiation device 12 are substantially rectangular structures.

The side UV light irradiation device 11 is positioned in parallel with the varnish print head 101 along the longitudinal forward conveying direction of the substrate, and the width $W_{UVA}$ (as measured in the substrate conveying direction) of the side UV light irradiation device 11 in a direction parallel with the varnish print head is less than or equal to the width $W_{phmzl}$ (as measured in the substrate conveying direction) of the varnish print head (i.e. $W_{UVA}<W_{phmzl}$), such that an overlapping ratio of an area traversed by the side UV light irradiation device 11 to an area traversed by the varnish print head is less than or equal to 100%.

The front UV light irradiation device 12 is positioned in front of the inkjet module 10 (i.e. "front" in terms of the longitudinal forward conveying direction of the substrate) without overlapping the varnish print head 101, in other words, during printing, the area traversed by the front UV light irradiation device 12 does not overlap with the area traversed by the varnish print head 101. In addition, the UV optical powers of the front UV light irradiation device 12 and the side UV light irradiation device 11 are the same.

Figure 8:
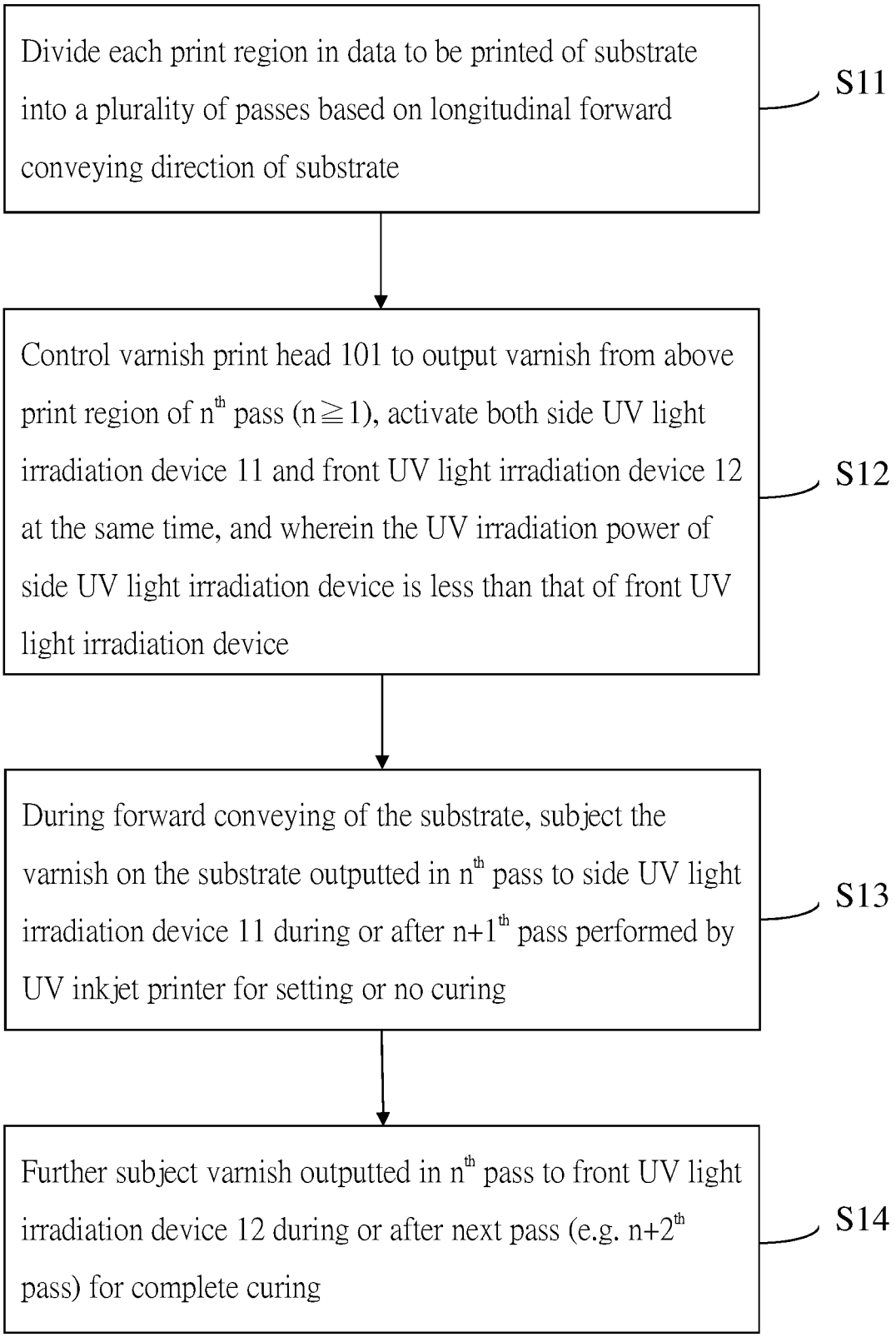
FIG. 8 is a flowchart illustrating a printing method using the multi-pass UV inkjet printer in accordance with an embodiment of the present invention.

As shown in FIG. 8, when the UV inkjet printer 1 is outputting a varnish, the following steps are performed:

- S11: Each print region in the data to be printed of a substrate is divided into a plurality of passes based on the longitudinal forward conveying direction of the substrate;
- S12: The varnish print head 101 is controlled to output varnish from above a print region of the $n^{th}$ pass ($n\geq1$), both the side UV light irradiation device 11 and the front UV light irradiation device 12 are activated at the same time, and wherein the UV irradiation power of the side UV light irradiation device is less than that of the front UV light irradiation device;
- S13: During forward conveying of the substrate, the varnish on the substrate outputted in the $n^{th}$ pass is subjected to the side UV light irradiation device 11 during or after the $n+1^{th}$ pass performed by the UV inkjet printer for shaping or not curing; and
- S14: The varnish outputted in the $n^{th}$ pass is then subjected to the front UV light irradiation device 12 during or after the next pass (e.g. the $n+2^{th}$ pass) for complete curing.

In the printing step S11 above, the width $W_{UVB}$ of an irradiation area of the front UV light irradiation device 12 is greater than the width of one pass. In addition, when the width of the side UV light irradiation device 11 is less than the width of the varnish print head 101, the width of the varnish print head 101 not overlapped by the side UV light irradiation device 11 in a direction perpendicular to the varnish print head 101 is greater than or equal to the width of one pass.

In the printing step S12 above, the UV irradiation power of the side UV light irradiation device 11 is less than that of the front UV light irradiation device 12. For example, the UV optical power outputted by the side UV light irradiation device 11 is 0 (not curing) or less than 100% (only for shaping) so as to allow the jetted varnish to undergo a delayed curing, and the UV optical power outputted by the front UV light irradiation device 12 is 100% to allow the jetted varnish to be completely cured.

Figure 4:
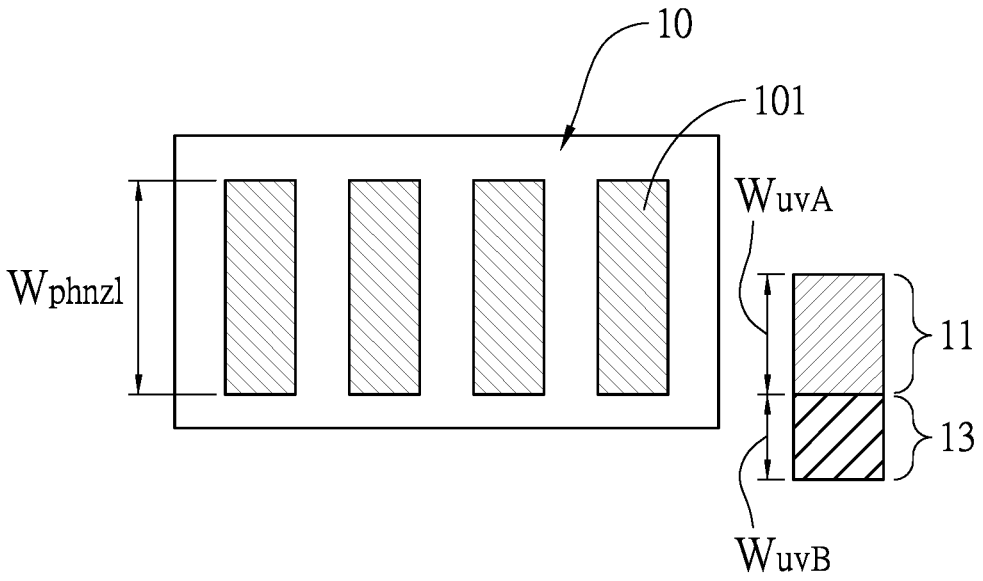
FIG. 4 is a schematic diagram depicting the configuration of a side UV light irradiation device and a front UV light irradiation device in a multi-pass UV inkjet printer in accordance with a second embodiment of the present invention.
Figure 5:
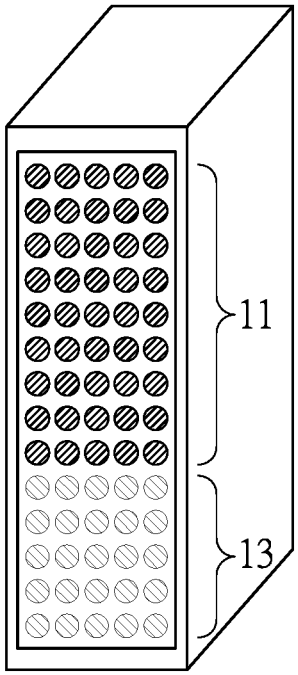
FIG. 5 is a partially enlarged view of an inkjet module in the embodiment of FIG. 4.

Referring to FIG. 4, the multi-pass UV inkjet printer 1 in accordance with a second embodiment of the present invention is shown, wherein a front UV light irradiation device 13 is provided under the side UV light irradiation device 11 and integrated therewith. As shown in FIG. 5, the locations of the side UV light irradiation device 11 and the front UV light irradiation device 13 in the longitudinal forward conveying direction are the same as those described with respect to the first embodiment.

Figure 6:
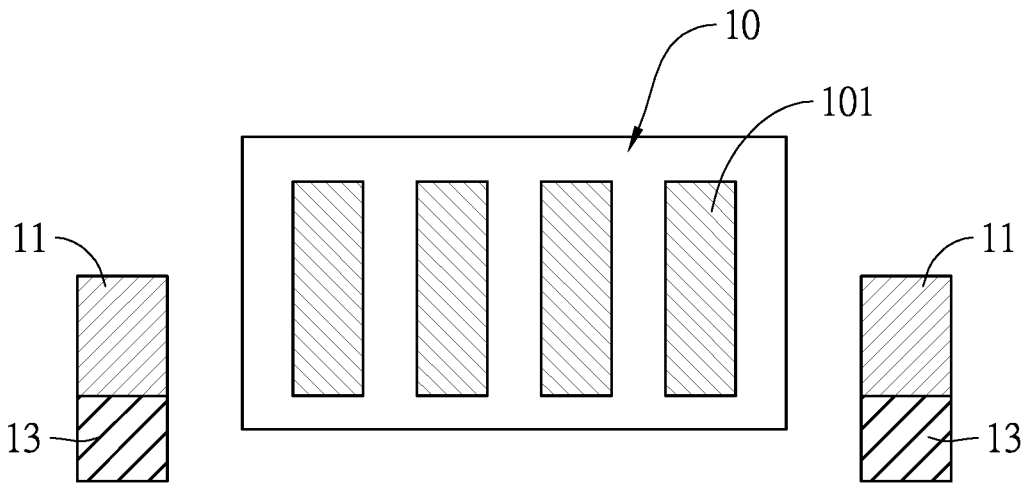
FIG. 6 is a schematic diagram depicting the configuration of a side UV light irradiation device and a front UV light irradiation device in a multi-pass UV inkjet printer in accordance with a third embodiment of the present invention.

Moreover, in a third embodiment shown in FIG. 6, the integrated side UV light irradiation device 11 and front UV light irradiation device 13 described in the second embodiment can be provided on both sides of the inkjet module 10, and the locations of the side UV light irradiation device 11 and the front UV light irradiation device 13 in the longitudinal forward conveying direction are the same as those described with respect to the first embodiment.

Figure 7:
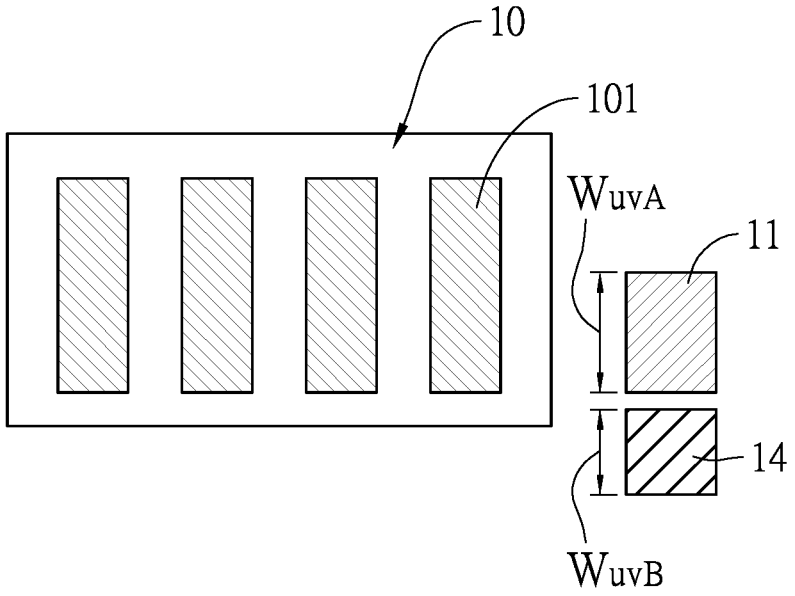
FIG. 7 is a schematic diagram depicting the configuration of a side UV light irradiation device and a front UV light irradiation device in a multi-pass UV inkjet printer in accordance with a fourth embodiment of the present invention.

Furthermore, in a fourth embodiment shown in FIG. 7, a front UV light irradiation device 14 is provided below the side UV light irradiation device 11 and separated from the side UV light irradiation device 11.

In other embodiments, the UV optical power of the front UV light irradiation device 12 may be different from the UV optical power of the side UV light irradiation device 11. However, during output of the varnish, the UV irradiation power used by the side UV light irradiation device 11 still needs to be less than the UV irradiation power used by the front UV light irradiation device 12.

Therefore, the present invention has the following advantages.

(1) The effect of delayed curing of the varnish is greater and the possibility of finding dust is lowered, thereby achieving a glossier printed surface.

(2) Compared to the traditional delayed curing method, the present invention does not require another separate run of the UV light curing process after the varnish is jetted. The varnish is shaped and cured in different passes in one process, which greatly reduces the delayed curing time by 50% and in turn significantly increases production yield, while reducing the influence of dust attachment and prolonging the life and thus the competitiveness of the multi-pass UV inkjet printer of the present invention.

(3) The side UV light irradiation device and the front UV light irradiation device of the present invention can be both smaller in size than the print heads, which reduces machine cost and maintenance cost.

In conclusion, as disclosed above, the present invention indeed achieves the objectives of the present invention by providing a multi-pass UV inkjet printer for outputting high glossy varnish and a method using the same with higher production yield and lower cost. The present invention has significant values in terms of industrial applications, a patent application is thus filed in accordance with the law.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A printing method using a multi-pass ultraviolet (UV) inkjet printer for outputting high glossy varnish, the UV inkjet printer including an inkjet module for performing a printing job by moving back and forth across the printer, the inkjet module having a varnish print head for outputting varnish on a substrate, the printing method comprising:

providing a side UV light irradiation device at a side of the inkjet module and a front UV light irradiation device in front of the inkjet module not overlapped by the varnish print head, wherein a width of the side UV light irradiation device in a direction parallel with the varnish print head is less than a width of the varnish print head, and wherein the width of the area not overlapped by the varnish print head and the side UV light irradiation device in a direction perpendicular to the varnish print head is greater than the width of one pass;

during output of the varnish, dividing each print region in data to be printed into a plurality of passes and activating the side UV light irradiation device and the front UV light irradiation device at the same time, wherein the irradiation power of the side UV light irradiation device is less than that of the front UV light irradiation device, such that when the substrate is being conveyed forward, varnish outputted on the substrate in a $n^{th}$ pass is passed under the side UV light irradiation device for shaping during or after a $n+1^{th}$ pass performed by the UV inkjet printer; and passing the varnish outputted on the substrate in the $n^{th}$ pass under the front UV light irradiation device for complete curing during or after a $n+2^{th}$ pass.

2. The printing method of claim 1, wherein the width of an irradiation area of the front UV light irradiation device is greater than the width of one pass.

3. The printing method of claim 1, wherein a width of the side UV light irradiation device in a direction parallel with the varnish print head is less than or equal to a width of the varnish print head.

4. The printing method of claim 1, wherein the side UV light irradiation device is greater than or equal to 0% of UV irradiation power activation, and the front UV light irradiation device is less than or equal to 100% of UV irradiation power activation to cure the varnish on the substrate.

* * * * *